US008201289B2

(12) United States Patent
Edmonds et al.

(10) Patent No.: US 8,201,289 B2
(45) Date of Patent: Jun. 19, 2012

(54) COMBINED CONTROL FOR A BASIN OVERFLOW AND A BASIN DRAIN

(75) Inventors: Cary D. Edmonds, Plymouth, WI (US); Katherine A. Stanchak, Medford, MA (US); Murali Natarajan, Sheboygan, WI (US)

(73) Assignee: Kohler Co., Kohler, WI (US)

( * ) Notice: Subject to any disclaimer, the term of this patent is extended or adjusted under 35 U.S.C. 154(b) by 386 days.

(21) Appl. No.: 12/494,415

(22) Filed: Jun. 30, 2009

(65) Prior Publication Data

US 2010/0325792 A1 Dec. 30, 2010

(51) Int. Cl.
*E03C 1/22* (2006.01)

(52) U.S. Cl. ..... 4/680; 4/682; 4/690; 4/693; 4/694

(58) Field of Classification Search ..... 4/680, 682, 4/683, 684, 679, 690, 693, 694, 688, 689
See application file for complete search history.

(56) References Cited

U.S. PATENT DOCUMENTS

| | | | | |
|---|---|---|---|---|
| 3,835,484 | A | 9/1974 | Kato | |
| 3,859,676 | A | 1/1975 | Kato | |
| 4,594,738 | A | 6/1986 | Gebert | |
| 5,025,509 | A | 6/1991 | Holt et al. | |
| 5,832,545 | A | 11/1998 | Pan | |
| 6,073,278 | A | 6/2000 | Ball | |
| 6,138,290 | A | 10/2000 | Lin | |
| 6,195,819 | B1 | 3/2001 | Wang | |
| 6,347,417 | B1 * | 2/2002 | Ohta | 4/689 |
| 6,363,544 | B1 | 4/2002 | Ryan | |
| 6,418,570 | B1 | 7/2002 | Ball | |
| 6,442,770 | B1 | 9/2002 | Lin | |
| 6,637,051 | B1 | 10/2003 | Swart | |
| 6,823,540 | B2 | 11/2004 | Gunn | |
| 6,880,179 | B2 | 4/2005 | Wang | |
| 7,013,500 | B1 | 3/2006 | Lin | |
| 7,290,295 | B2 | 11/2007 | Pan | |
| 2004/0226085 | A1 | 11/2004 | Wang | |

FOREIGN PATENT DOCUMENTS

| | | |
|---|---|---|
| CN | 2005-10004349 | 1/2006 |
| DE | 20018294 U | 2/2001 |
| EP | 1010825 | 6/2000 |
| EP | 1612337 | 4/2006 |
| EP | 1703027 | 9/2006 |
| EP | 1813732 | 8/2007 |

OTHER PUBLICATIONS 8 pages of an PCT search report dated Sep. 10, 2010 in the corresponding PCT US2010/038462 application.
Partial translation of Japanese publication H07-14455, published Aug. 23, 1990.

* cited by examiner

*Primary Examiner* — Huyen Le
*Assistant Examiner* — Erin Deery
(74) *Attorney, Agent, or Firm* — Foley & Lardner LLP

(57) ABSTRACT

A control is provided adjacent an overflow of a bathtub or sink. It both remotely controls operation of a basin bottom drain, and provides an option of shutting off flow through the overflow. Rotation of a handle of the control controls the bottom drain, and axial movement of the handle controls flow through the overflow. For example, a clicker-type pop-out valve can control overflow flow. Slot and projection structures restrict use of the overflow shutoff when the drain is not closed, and/or in some circumstances even when the drain is closed.

20 Claims, 7 Drawing Sheets

COMBINED CONTROL FOR A BASIN OVERFLOW AND A BASIN DRAIN

CROSS-REFERENCE TO RELATED APPLICATIONS

Not applicable.

STATEMENT REGARDING FEDERALLY SPONSORED RESEARCH

Not applicable.

BACKGROUND OF THE INVENTION

The present invention relates to basin type plumbing fixtures (especially bathtubs and sinks). More particularly it relates to controls useable with such basins that can both govern flow through a basin's lower drain outlet and the basin's overflow outlet.

It is conventional to have a drain outlet at the bottom of a bathtub, sink or the like, and an overflow outlet positioned adjacent an upper rim. If water is running into the basin, and the bottom drain is closed or clogged, continued flow could cause excess water to spill, absent such an overflow. As such, these overflows are typically designed so that if water rises too high in the basin, before reaching the rim and spilling the water will instead pass out the overflow outlet and go to a by-pass drain line. See e.g. U.S. Pat. No. 3,835,484.

The bottom drain outlet used with these basins is typically controlled by a plug or stopper that is remotely actuatable without the need to touch the plug itself. This is often achieved through the use of mechanical levers or cable linkages. See e.g. U.S. Pat. No. 6,637,051. It is also sometimes achieved where an actuator for the linkage is associated with a control mounted adjacent the overflow outlet. See e.g. U.S. Pat. No. 4,594,738.

Regardless, provision is typically made to always leave the overflow outlet open. Whatever benefits this has for avoiding spillage, it necessarily also prevents the tub from being filled up all the way to the rim. Hence, some volume capacity of the tub is "wasted". This can make it difficult for large consumers to have their torso completely immersed during bathing when using standard size bathtubs.

There have therefore been some attempts to have a drain control that also provides an option to close off the overflow somewhat when extra water volume is desired in the tub. See e.g. U.S. Pat. Nos. 3,835,484 and 3,859,676. However, these prior designs could increase clogging potential by mounting linkages along the drain passageways, and in any event were non-intuitive and relatively expensive to produce.

In separate work there have been a variety of drain stoppers developed which act somewhat like a ballpoint pen. When stepped on once they will click to a closure position. When stepped on a second time they will click to an open position. Hence, using a foot (or optionally a hand) the bottom drain outlet can be controlled by direct contact. See e.g. U.S. Pat. Nos. 6,195,819, 6,442,770 and 6,880,179. However, this requires a willingness to have a foot or hand pass through standing water to open the bottom drain after use, may leave an uncomfortable projection in the tub, and in any event does not address control of the overflow outlet.

There is therefore a need for providing improved combined controls for basin bottom drains and overflow outlets.

SUMMARY OF THE INVENTION

One aspect of the invention provides a combined control for a basin overflow and basin drain. The controls of the present invention are particularly suitable for use with bathtubs such as standard bathtubs or whirlpools.

There is an operator mountable adjacent a basin overflow, a drain closure valve mountable adjacent a basin drain, and a linkage extending between the operator and the drain closure valve such that rotation of a portion of the operator can cause movement of the drain closure valve between an open and a closed position. There is also a seal portion of the operator mounted for axial movement between two axial positions, and a pop-out type activator portion of the operator linked to the seal.

When installed, a first push of the activator (e.g. on a handle portion thereof) will move the seal from a first of the two axial positions to a second of the two axial positions. This will close off the overflow. Then, a second push of the activator in the same direction will pop the seal back to the first of the two axial positions.

Preferably, the seal is in a form of an overflow stopper skirt which is annular, and the activator includes a post defining a cavity extending along an axis, a sleeve member telescoped over the post, and a spring positioned within the cavity.

Note that the term "seal" is not intended to require a complete closure. Rather, it is enough that the closure be sufficient to permit water to rise past the overflow towards the rim. Moreover, it is not required that a gasket-type seal be present.

In other preferred forms the actuator is linked to a rotatable handle that controls movement of the drain closure valve. One can then, in one rotational position, push the handle axially to cause the overflow seal to initiate, and a second push will end the overflow seal.

In especially preferred forms the construction is such that axial handle movement is precluded when the drain outlet is open, and can be precluded even when the drain outlet is closed (if desired). However, there is a third rotational position of the handle that permits axial handle movement when the drain outlet is closed. This can be facilitated with a projection and slot construction.

In one form rotation of the handle causes movement of a cam which in turn causes a cable linkage to open or close the primary drain. That same handle can be pushed to first close the overflow, and then pushed again in the same direction to open the overflow.

Hence, a single operator will govern flow through the basin's bottom drain outlet, will preclude the overflow from being closed in some rotational positions, and will permit the overflow to be closed in another rotational position. The operational mechanism is highly intuitive, and thus something that does not require extensive explanation to first-time users.

Moreover, the product can be manufactured at reasonably low additional cost (relative to a standard cable driven drain control which does not have overflow control). Also, as pop-up type valves have been shown to have long-term reliability in this type of environment as applied to bottom drains, it is highly likely that incorporating them into the present assembly will not trigger significant maintenance issues.

The foregoing and still other advantages of the invention will appear from the following description. In that description reference is made to the accompanying drawings which form a part hereof and in which there is shown by way of illustration a preferred embodiment of the invention. That embodiment does not represent the full scope of the invention. Rather, the claims should be looked to in order to judge the full scope of the invention.

DETAILED DESCRIPTION OF THE INVENTION

Figure 1:
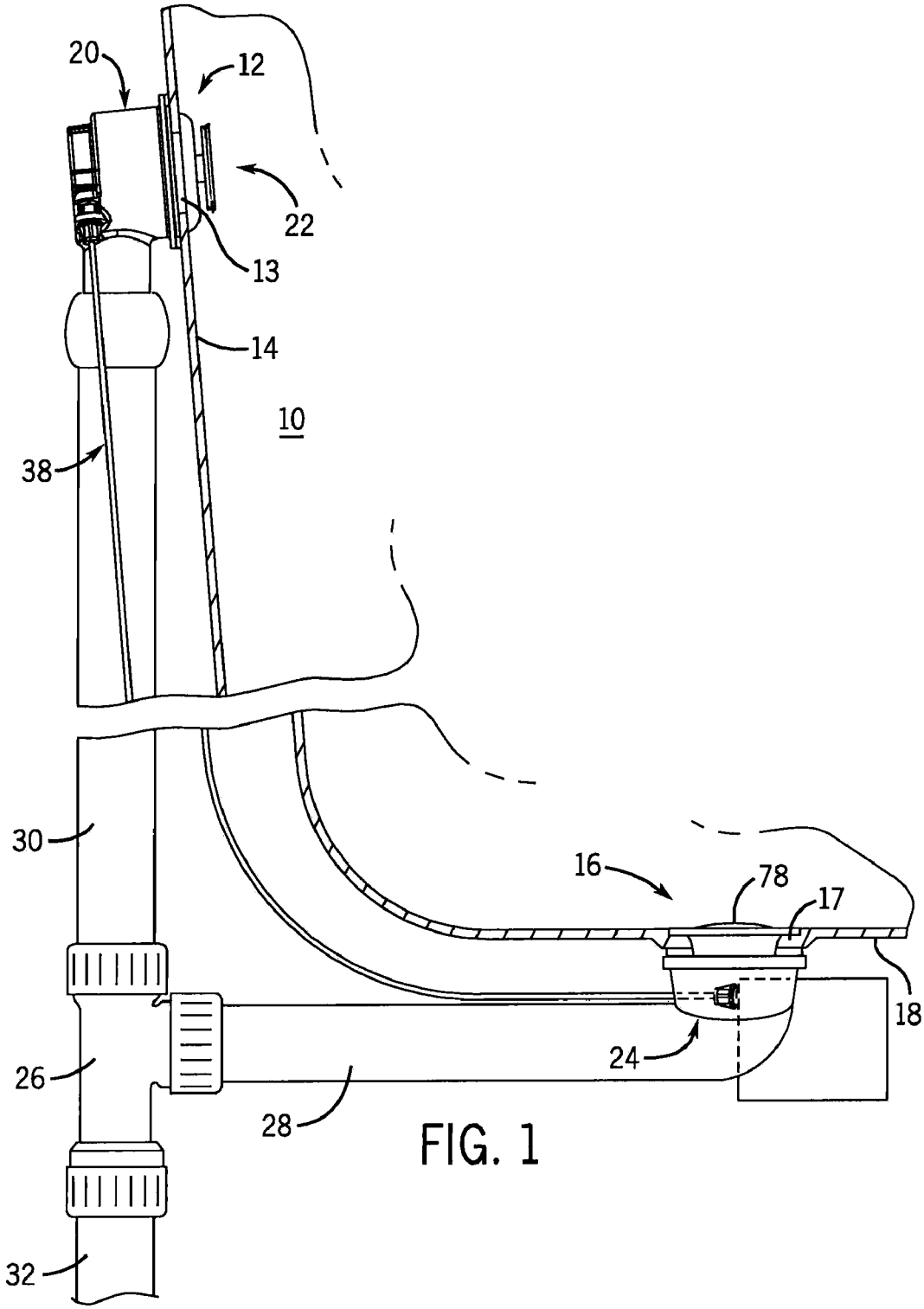
FIG. 1 is a side elevational view, partly in section, of a bathtub which has been installed with a combined control of the present invention.

Referring initially to FIG. 1, there is shown a bathtub generally 10 having a control 12 provided through an overflow opening 13 of the side wall 14. There is also a drain outlet valve 16 positioned at a bottom opening 17 of a basin bottom wall 18.

Housing 20 is mounted to the side wall 14 and an actuator handle 22 controls both drain closure and overflow closure. Housing 24 is mounted to the bottom wall 18 in communication with the drain outlet valve 16. A T-shaped fitting 26 connects a cross channel 28 coupled to the housing 24, and a down channel 30 couples to the housing 20 and also a sewer line 32.

Figure 2:
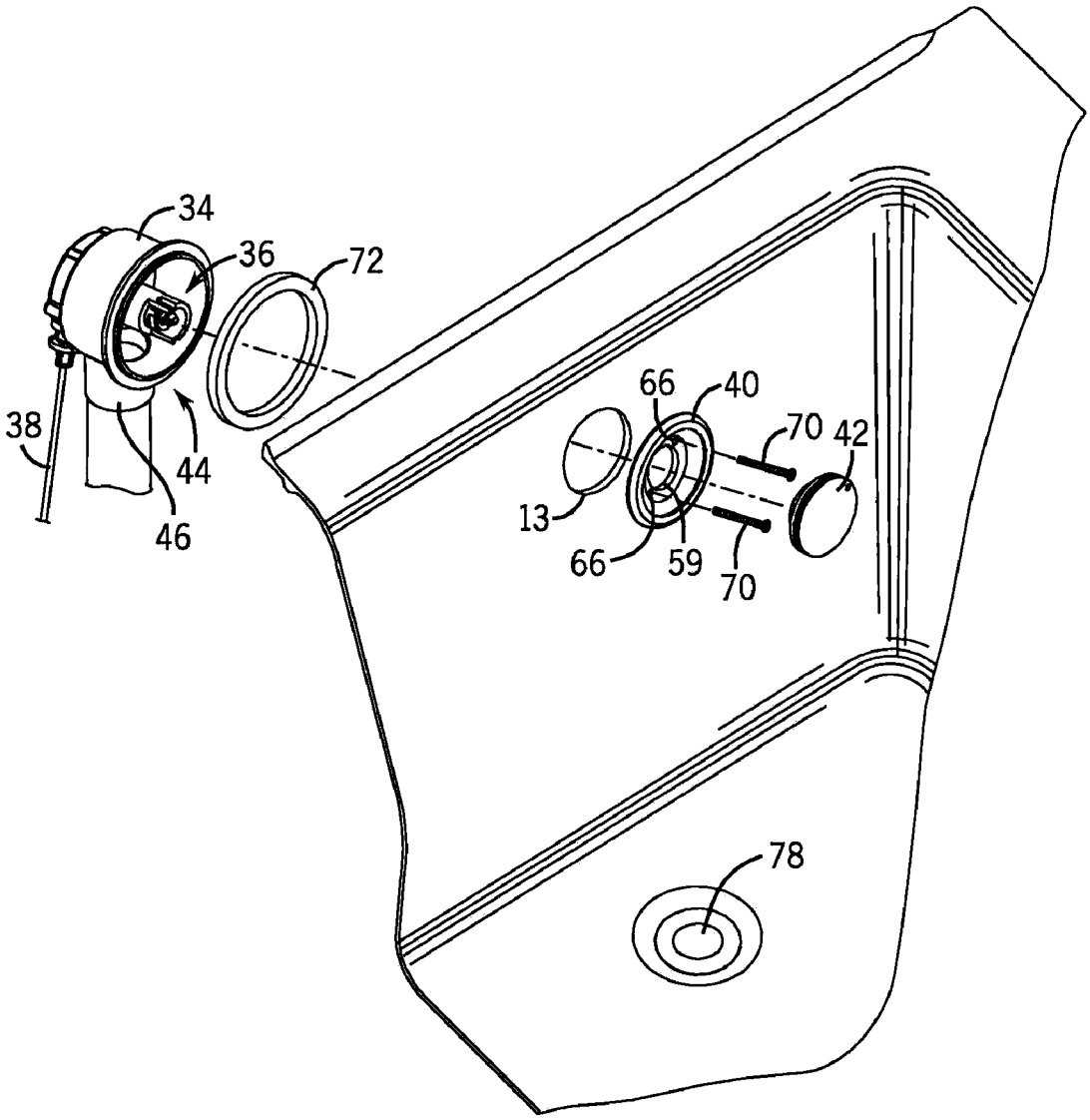
FIG. 2 is a partially exploded perspective view focusing on the overflow area of the bathtub.

Referring now also to FIG. 2, housing 20 has a cylindrical portion 34, and retains an actuating assembly 36 and the beginnings of cable linkage 38. There is also a drain flange/escutcheon 40. Note that the handle 22 also has an edge 42 which functions as a stopper. The cylindrical portion 34 has an open front inlet end 44, and includes an outlet port 46.

Figure 4:
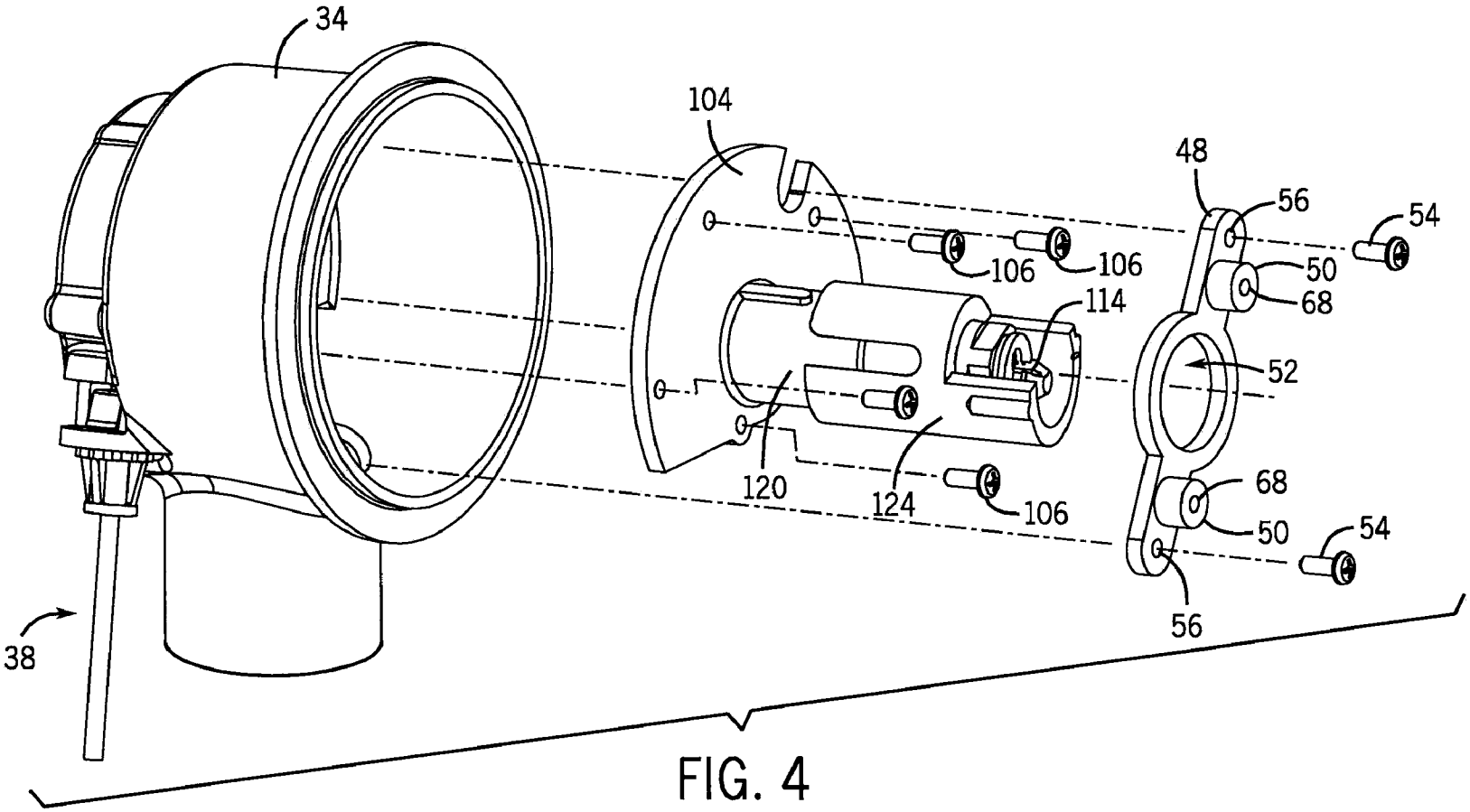
FIG. 4 is an enlarged, partially exploded view somewhat similar to FIG. 3, but showing a further stage of assembly.

Referring now also to FIG. 4, a cross bar 48 is provided to enable the escutcheon 40 and cylindrical portion 34 to be coupled to secure the assembly to the bathtub 10. The cross bar 48 includes posts 50 on radially opposite sides of a central aperture 52. The central aperture 52 permits the cross bar 48 to be inserted into the cylindrical portion 34 over the actuating assembly 36. The cross bar 48 is secured via fasteners 54 inserted through apertures 56 formed at ends of the bar 48.

Figure 6:
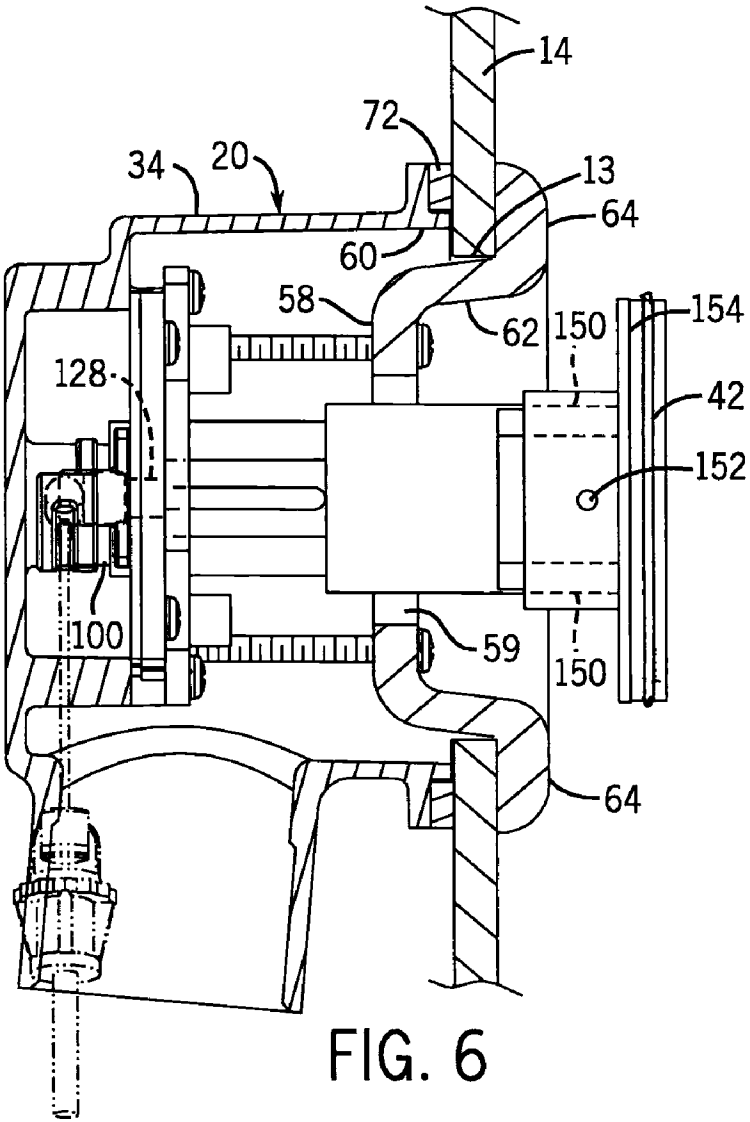
FIG. 6 is an enlarged sectional view of the overflow area, when both the drain and overflow outlets are open.

Referring now also to FIG. 6, the escutcheon 40 has an inner rim 58 surrounding an opening 59, sized to extend beyond an outer rim 60 when it is inserted into the opening 13 of the bathtub 10. The escutcheon 40 has a frustoconical surface 62 extending outwardly to a lip 64 with a diameter larger than the drain opening 13 to prevent it from being pressed through.

A pair of apertures 66 are formed through the inner rim 58 of the escutcheon 40. The lip 64 of the escutcheon 40 rests on the side wall 14 and the apertures 66 in the inner rim 58 are aligned with openings 68 in the vertical posts 50 of the cross-bar 48 secured within the cylindrical portion 34. Fasteners 70 extend through the openings 66 and are threaded into the vertical legs 50. The fasteners 66 are tightened to draw the cylindrical portion 34 and escutcheon 40 towards each other and into contact with opposing sides of the side wall 14. A rubber gasket 72 positioned on the outer rim 60 seals against the bathtub 10.

Figure 3:
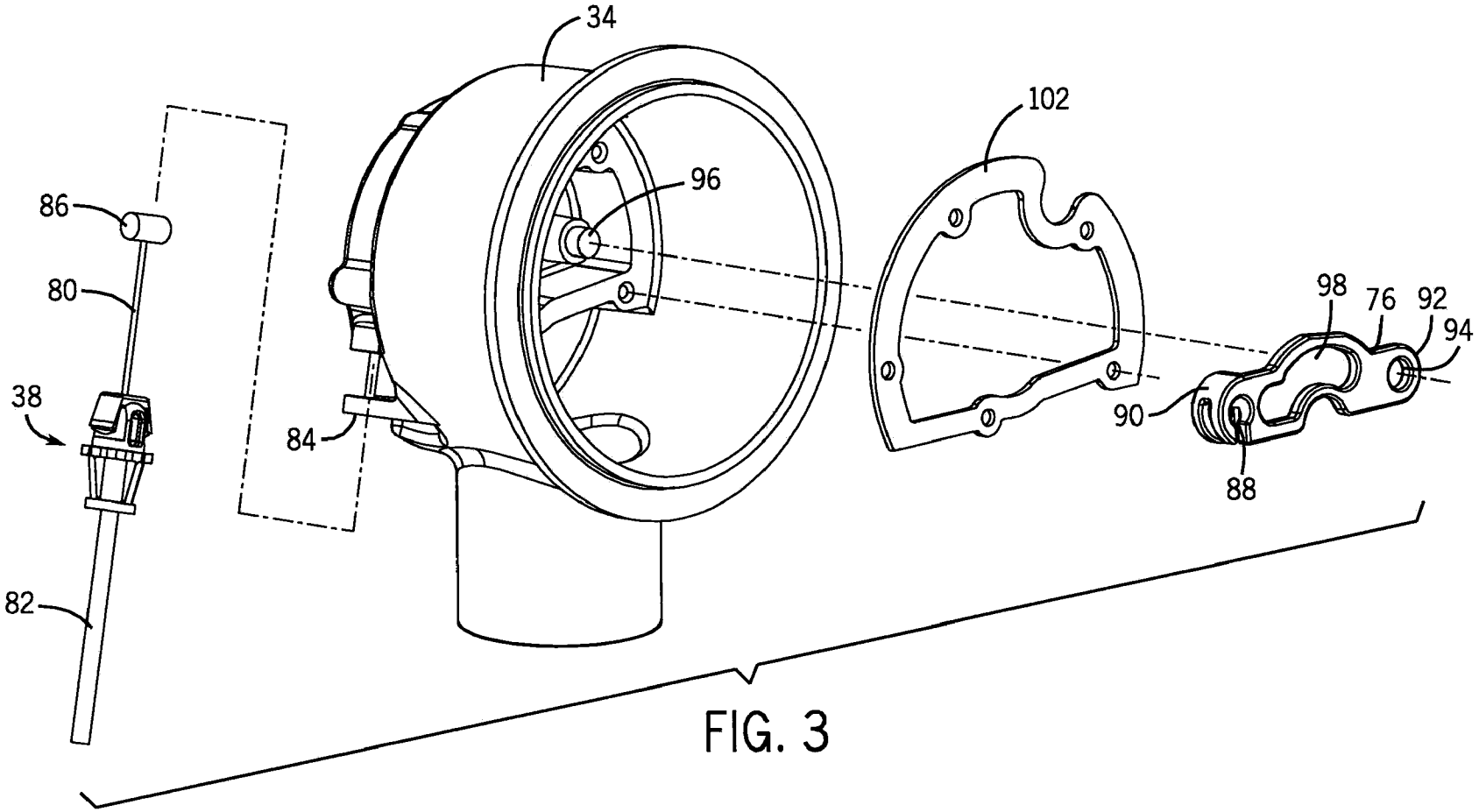
FIG. 3 is an enlarged, partially exploded assembly view of a portion of the control.
Figure 5:
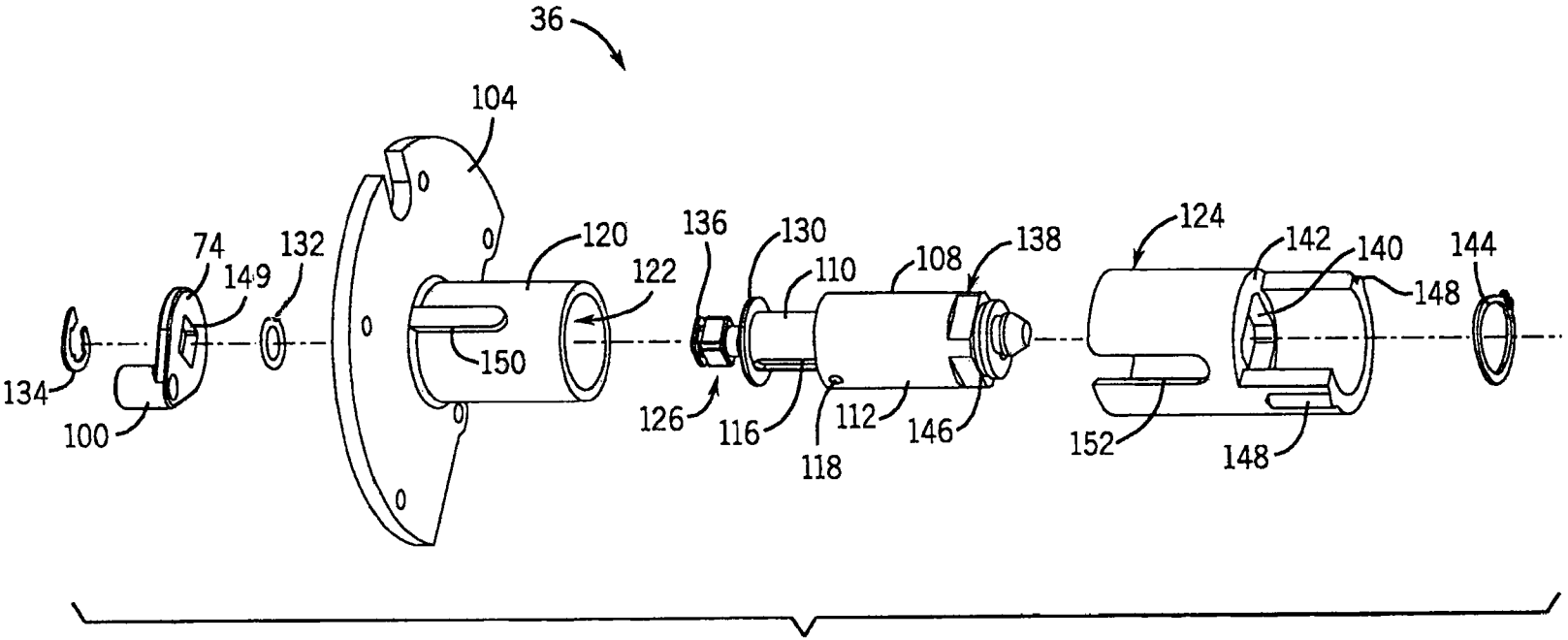
FIG. 5 is an exploded view of an actuating assembly of FIG. 4.

Referring now also to FIGS. 3 and 5, an actuating assembly 36 includes a cam 74 and cam linkage 76 coupled to a waste drain stopper 78 via the cable linkage 38. As shown, the cable linkage 38 includes a movable cable 80 and a protective sheath 82. The cable 80 enters the cylindrical portion 34 via an opening 84 and a barrel-shaped end 86 is received by a slotted aperture 88 in a first end 90 of the cam linkage 76.

A second end 92 of the cam linkage 76 includes an aperture 94 that is positioned onto an integral pivot post 96. An arcuate opening 98 extending across the cam linkage 76 receives a toe 100 projecting outwardly from the cam 74 when assembled within the cylindrical portion 34. The cable linkage 38, cable opening 84, cam 74, and cam linkage 76 are sealed within the cylindrical portion 34 via a gasket 102 and plate 104 fastened by screws 106.

Figure 7:
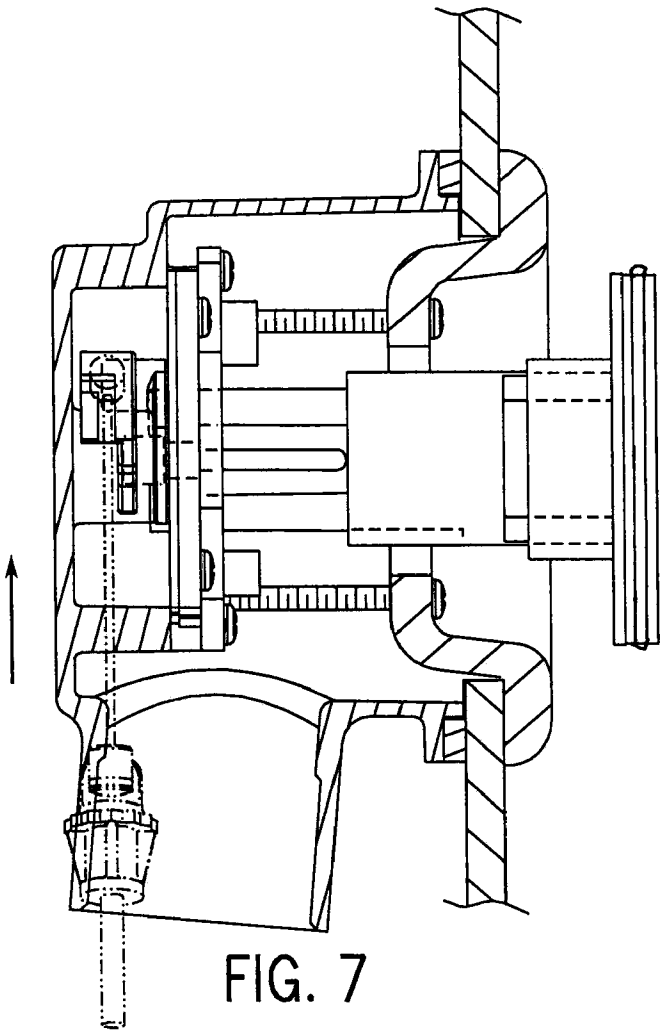
FIG. 7 is a view similar to FIG. 6, but showing the configuration when the bottom drain outlet is closed and the overflow is open.

The actuating assembly 36 is rotatable, via the handle/stopper 42, to effect pivotable movement of the cam linkage 76. At a first angular position shown in FIG. 6, the toe 100 is adjacent to the first end 90 of the linkage 76 and the waste drain stopper 78 is open. Moving the actuating assembly 36 to a second angular position, such as shown in FIG. 7, causes the cam 74 to rotate, pivoting the cam linkage 76 and pulling the cable 80.

Figure 8:
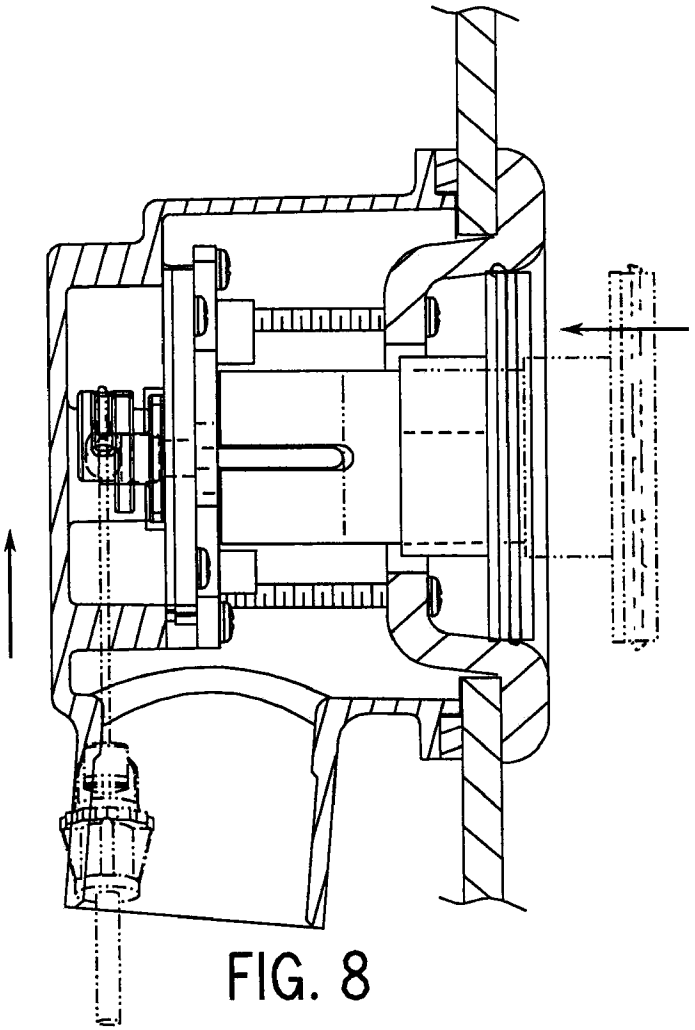
FIG. 8 is a view similar to FIG. 6, but showing the configuration when both the bottom drain out and overflow are closed.

Although not illustrated, the other end of the cable 80 is linked to an internal second pivot in the housing 24 which pivots a part under the waste drain stopper 78 to pull the stopper 78 closed. At a third angular position of the actuating assembly 36 shown in FIG. 8, the handle/stopper 42 can be pressed into and out of the escutcheon 40.

As seen best in FIG. 5, the actuating assembly 36 includes a clicker assembly 108 to temporarily hold the handle/stopper 42 against the inner rim 58 of the escutcheon 40 to close the overflow opening 13. The clicker assembly 108 includes a post 110 and a cylindrical sleeve 112 partially telescoped onto the post 110. Axial movement of the sleeve 112 further onto the post 110 is resisted by a compression spring (not shown) captured between the post 110 and the sleeve 112. A catch wire 114 (FIG. 4) secures the sleeve 112 to the post 110. Radial movement of the sleeve 112 relative to the post 110 is prevented by a groove 116 in the post 110 and a set screw 118 extending through the outer sleeve 112.

A conventional clicker assembly 108 includes a circuitous groove (not shown) formed in the post 110 to guide an end of the catch wire 114. The end of the catch wire 114 travels within the groove allowing the sleeve 112 to telescope between an open, intermediate, and closed position. When the post 110 is axially fixed in place, a pressing force causes the spring to compress and the sleeve 112 is moved from an open to an intermediate position. When the force against the sleeve 112 is released, the spring decompresses slightly, moving the sleeve 112 to the closed position. A subsequent pressing force moves the sleeve 112 back to an intermediate position and after the subsequent force against the outer sleeve 112 is released, the spring forces the sleeve 112 back to the open position.

Various other known clicker assemblies may be used. See e.g. clicker 2 of U.S. Pat. No. 6,442,770.

The actuating assembly 36 includes the aforementioned plate 104 which has a central boss 120 defining a cavity 122 and a telescoping sleeve 124 received over the boss 120. The clicker assembly 108 is received within the central boss 120 with one end portion 126 of the post 110 extending through an opening 128 in the plate 104 with an integral flange 130 on the post 110 abutting against the plate 104 from inside the boss 120.

An o-ring 132 on the end portion 126 of the post 110 prevents leakage into the sealed portion of the cylindrical portion 34. The cam 74 is retained on the end portion 126 of the post 110 via a c-clip 134 inserted into a groove 136 and abuts the opposing side of the plate 104. Together, the integral flange 130 and cam 74 keep the clicker assembly 108 affixed to the plate and within the boss 120.

The clicker assembly 108 extends through the boss 120 and into the telescoping outer sleeve 124. A beveled square-shaped portion 138 of the inner sleeve 112 passes through a similarly shaped opening 140 in an axial face 142 of the outer sleeve 124. A c-clip 144 inserted into a groove 146 in the square-shaped portion 138 secures the outer sleeve 124 to the clicker assembly 108.

Ribs 148 formed in the outer sleeve 112 are received in slots 150 in the handle 42. A set screw 152 prevents the handle 42 from being pulled off of the outer sleeve 124.

Rotation of the outer sleeve 124 translates into rotation of the clicker assembly 108 due to the interface between the square-shaped portion 138 of the clicker assembly sleeve 112 and the matching square-shaped opening 140 in the outer sleeve 124. Likewise, the rotation of the clicker assembly 108 translates into rotation of the cam 74 due to the interface between the end portion 126 of the post 110 and a square-shaped opening 149 in the cam 74.

Importantly, in the first (drain open) and second (drain closed, but overflow protection desired) angular positions, an axial projection 150 on the central boss 120 prevents axial movement of the outer sleeve 124 and handle/stopper 42. However, in the third (more rotationally extreme) angular position, a slot 152 in the outer sleeve 124 is aligned with the projection 150 on the central boss 120. Pressing against the handle 42 moves the handle 42 and sleeve 124 connected thereto into contact with the escutcheon 40. The handle/stopper 42 is preferably disk-shaped and provided with an annular rubber gasket 154. The gasket 154 and stopper 42 are sized to fit tightly against the inner rim 58 of the escutcheon 40 to make a water tight seal at the overflow opening 13.

The clicker assembly 108 automatically holds the handle 42 in a closed position. Subsequently pressing the handle 42 releases the handle 42 back to an open position. The handle 42 may then be rotated back to the second or first angular position as desired.

Hence, a single control will remotely activate the bottom drain for the tub, and also provide an option for closing off the overflow. The assembly is designed so that normally the overflow won't be closed off (even when the tub bottom drain is closed). However, when a conscious decision is made to shutoff the overflow, further rotation of a handle, followed by a pushing motion, can intuitively cause the overflow shutoff.

While a specific embodiment of the present invention has been shown, various modifications falling within the breadth and scope of the invention will be apparent to one skilled in the art. For example, the assembly need not rely on cable linkage, as distinguished from mechanical leverage systems, to activate the bottom drain. Thus, the following claims should be looked to in order to understand the full scope of the invention.

INDUSTRIAL APPLICABILITY

Disclosed is a combined control for basin bottom drain and basin overflow, particularly where the bottom drain can be controlled separately from overflow control.

What is claimed is:

1. A combined control for a basin overflow and basin drain, comprising:

an operator mountable adjacent to the basin overflow;

a drain closure valve mountable adjacent to the basin drain;

a linkage extending between the operator and the drain closure valve such that rotation of a portion of the operator can cause movement of the drain closure valve between an open and a closed position;

a seal portion of the operator mounted for axial movement between two axial positions; and a pop-out type activator portion of the operator linked to the seal, whereby a first push of the activator will move the seal from a first of the two axial positions to a second of the two axial positions, and a second push of the activator will pop the seal back to the first of the two axial positions;

wherein rotation of the operator can control opening and closing of the drain closure valve and axial movement of the operator can control flow through the basin overflow; and wherein when the drain closure valve is in the closed position, the basin overflow can be either closed by the operator or not closed by the operator.

2. The combined control for a basin overflow and basin drain of claim 1, wherein: the seal is an annular seal; and the activator comprises: (i) a post defining a cavity extending along an axis; (ii) a sleeve member telescoped over the post; (iii) a spring positioned within the cavity.

3. The combined control for a basin overflow and basin drain of claim 1, wherein a projection and slot construction governs axial movement of the operator.

4. A combined control for a basin overflow and basin drain, comprising:

a drain closure configured to be mounted at the basin drain for controlling a flow of water through the basin drain; and a overflow closure configured to be mounted at the basin overflow for controlling a flow of water through the basin overflow, the overflow closure having a handle configured to be actuated by a user, wherein rotation of the handle by the user is configured to control opening and closing of the drain closure and axial movement of the handle by the user is configured to control opening and closing of the basin overflow.

5. The combined control for a basin overflow and basin drain of claim 4, wherein the overflow closure comprises a pop-out activator whereby a first push of the handle by the user in an axial direction is configured to move the overflow closure to a closed position and a second push of the handle by the user in the axial direction is configured to pop the overflow closure back to an open position.

6. The combined control for a basin overflow and basin drain of claim 5, wherein the pop-out activator comprises:

a post defining a cavity extending along an axis;

a sleeve member telescoped over the post; and a spring positioned within the cavity.

7. The combined control for a basin overflow and basin drain of claim 4, further comprising a seal supported at an outer periphery of the handle.

8. The combined control for a basin overflow and basin drain of claim 7, wherein the seal is an annular seal extending continuously around the outer periphery of the handle.

9. The combined control for a basin overflow and basin drain of claim 4, further comprising a linkage extending between the drain closure and the overflow closure.

10. The combined control for a basin overflow and basin drain of claim 9, wherein the overflow closure comprises a housing configured to be supported at a side wall of the basin on a side opposite the handle, the housing having an outer rim that is configured to be seated against the side wall.

11. The combined control for a basin overflow and basin drain of claim 10, wherein the overflow closure further comprises a cam and a cam linkage supported within the housing and configured to be coupled to the drain closure via the linkage, wherein rotation of the handle is configured to cause the cam to rotate which in turn causes the cam linkage to pivot which in turn acts on the linkage to move the drain closure.

12. The combined control for a basin overflow and basin drain of claim 10, wherein the overflow closure further comprises an escutcheon configured to be supported at the side wall of the basin on a side opposite the housing, the escutcheon having an inner rim that is configured to be received by an opening defined by the outer rim of the housing.

13. The combined control for a basin overflow and basin drain of claim 10, wherein the handle is configured to be pressed into and out of the escutcheon by the user.

14. The combined control for a basin overflow and basin drain of claim 4, wherein when the drain closure is in the closed position, the basin overflow can be either closed by the user or not closed by the user.

15. The combined control for a basin overflow and basin drain of claim 4, wherein the handle is rotatable between a first position wherein the drain closure is open, a second position wherein the drain closure is closed and a third position wherein the drain closure is closed, wherein the overflow closure comprises a blocking device that restricts the axial movement of the handle when the handle is in the second position such that the basin overflow cannot be closed, but allows the axial movement of the handle when the handle is in the third position such that the basin overflow can be closed.

16. The combined control for a basin overflow and basin drain of claim 15, the blocking device comprises a projection that restricts the axial movement of the handle.

17. The combined control for a basin overflow and basin drain of claim 15, wherein an angular distance between the handle in the first position and the handle in the second position is less than an angular distance between the handle in the first position and the handle in the third position.

18. A combined control for a basin overflow and basin drain, comprising:

an operator mountable adjacent to the basin overflow;

a drain closure valve mountable adjacent to the basin drain;

a linkage extending between the operator and the drain closure valve such that rotation of a portion of the operator can cause movement of the drain closure valve between an open and a closed position;

a seal portion of the operator mounted for axial movement between two axial positions; and a pop-out type activator portion of the operator linked to the seal, whereby a first push of the activator will move the seal from a first of the two axial positions to a second of the two axial positions, and a second push of the activator will pop the seal back to the first of the two axial positions;

wherein rotation of the operator can control opening and closing of the drain closure valve and axial movement of the operator can control flow through the basin overflow when the seal portion is against the basin overflow; and wherein when the drain closure valve is in the closed position, the basin overflow can be either closed by the operator or not closed by the operator.

19. The combined control for a basin overflow and basin drain of claim 18, wherein: the seal is an annular seal; and the activator comprises: (i) a post defining a cavity extending along an axis; (ii) a sleeve member telescoped over the post; (iii) a spring positioned within the cavity.

20. The combined control for a basin overflow and basin drain of claim 18, wherein a projection and slot construction governs axial movement of the operator.

* * * * *